US006010277A

United States Patent [19]

Follman

[11] Patent Number: 6,010,277

[45] Date of Patent: Jan. 4, 2000

[54] ROAD SPEED LIMITING DEVICE

[76] Inventor: Aaron Follman, 60 Chai Taib Street, 95405 Jerusalem, Israel

[21] Appl. No.: 08/981,156

[22] PCT Filed: Jun. 12, 1996

[86] PCT No.: PCT/IL96/00013

§ 371 Date: May 22, 1998

§ 102(e) Date: May 22, 1998

[87] PCT Pub. No.: WO97/00181

PCT Pub. Date: Jan. 3, 1997

[30] Foreign Application Priority Data

Jun. 15, 1995 [IL] Israel ..... 114163

[51] Int. Cl.[7] ..... E01F 9/00; E01F 11/00; E05F 15/20

[52] U.S. Cl. ..... 404/11; 404/10; 404/15; 49/21

[58] Field of Search ..... 404/6, 10, 11, 404/15, 16, 84.05; 49/21, 31, 49, 131

[56] References Cited

U.S. PATENT DOCUMENTS

| | | | |
|---|---|---|---|
| Re. 33,201 | 4/1990 | Dickinson . | |
| 1,878,234 | 9/1932 | Goodman . | |
| 3,256,637 | 6/1966 | Torrey | 49/131 |
| 3,491,482 | 1/1970 | Wedekind . | |
| 3,626,637 | 12/1971 | Rudicel . | |
| 3,748,782 | 7/1973 | Reynolds . | |
| 4,332,503 | 6/1982 | Hurst, Jr. . | |
| 4,342,525 | 8/1982 | Mastronuzzi, Jr. . | |
| 4,490,068 | 12/1984 | Dickinson . | |
| 4,627,763 | 12/1986 | Roemer et al. . | |
| 4,850,737 | 7/1989 | Nasatka et al. . | |
| 4,861,185 | 8/1989 | Eikelenboon . | |
| 4,974,991 | 12/1990 | Mandavi . | |
| 5,131,631 | 7/1992 | Cobbe | 256/17 |
| 5,267,808 | 12/1993 | Welford . | |
| 5,419,537 | 5/1995 | Thompson | 256/17 |
| 5,486,065 | 1/1996 | James | 404/15 |

FOREIGN PATENT DOCUMENTS

| | | | |
|---|---|---|---|
| 370 154 | 5/1990 | European Pat. Off. | 404/15 |
| 3632673 | 9/1986 | Germany . | |

*Primary Examiner*—Thomas B. Will
*Assistant Examiner*—Gary S. Hartmann
*Attorney, Agent, or Firm*—Abelman, Frayne & Schwab

[57] ABSTRACT

A variable speed bump apparatus comprising a pivoting ramp element hinged at one end, at least one piston and cylinder assembly supporting the pivoting ramp element and a first flow control valve and wherein the first flow control valve is operative to control the response of the pivoting ramp element.

12 Claims, 14 Drawing Sheets

ROAD SPEED LIMITING DEVICE

FIELD OF THE INVENTION

The present invention relates to speed bumps and more particularly to variable speeds bumps.

BACKGROUND OF THE INVENTION

Speed bumps are widely used as a device for compelling drivers to decrease their speed, especially in speed restricted areas. The speed bumps are generally deployed along a road at appropriated distances and are generally integrally constructed as a part of the road. Warning signs are usually located along the road to warn a driver of the approaching speed bump. As the driver approaches the speed bump, the driver generally decreases the speed of the car in order to avoid hitting the speed bump at a high speed.

However, the warning signs are not generally effective in slowing down fast drivers and additionally even if the driver slows down to the required speed, the car may still suffer a jolt. Such a jolt may not only be a serious nuisance but may even damage the car. Furthermore, the jolt may even be sufficiently strong so as to cause injury to the car travelers.

Additionally, the driver may not always be aware of the existence of these speed bumps, especially when driving at night which will make the speed bumps even more annoying.

U.S. Pat. No. 5,267,808 to Welford describes a retractable electronically controlled speed bump with a microprocessor controller and a vehicle speed sensor. The controller is operative to extend or retract the speed bump in response to the sensed speed of an oncoming vehicle.

U.S. Pat. No. 4,974,991 to Mandavi describes a speed bump apparatus comprising a transverse bump bar, a pendulum and a mechanical locking mechanism.

U.S. Pat. No. 4,627,763 to Roemer describes a barrier apparatus comprising a pivoting barrier with energy absorbing members and hydraulic motors for raising the barrier thereby preventing unauthorized passage of vehicles.

U.S. Pat. No. 3,748,782 to Reynolds describes a mechanically activated traffic flow controller movable between a raised position and lowered position when a vehicle drives over it. The barrier is raised to an intermediate position when the front wheels of a vehicle pass thereover and is moved to the raised position when the rear wheel move thereover.

U.S. Pat. No. 4,342,525 to Mastronuzzi describes a retractable speed bump comprising moveable wedge shaped members and an upper member which may be moved above street level.

U.S. Pat. No. 4,332,503 to Hurst describes a pivotally mounted ramp for allowing a vehicle to travel substantially freely in one direction while impeding the traffic in the opposite direction.

U.S. Pat. No. 1,878,234 to Goodman describes a retractable speed bump useful in controlling vehicle access at a railroad grade crossing.

U.S. Pat. No. Re. 33,201 to Dickinson describes a retractable barrier activated by a motor driven pump and hydraulics for providing impact absorption to protect the hydraulic system.

There is a need in the art therefore for a speed bump which will be effective for slowing down cars traveling above a given speed limit. Additionally there is a requirement for a speed bump whose slowing down effect is speed dependent and will not be of a nuisance value.

SUMMARY OF THE INVENTION

The present invention seeks to provide an improved variable speed road bump whose impact on a vehicle is dependent on the speed of the vehicle.

There is thus is provided in accordance with a preferred embodiment of the present invention a variable speed bump apparatus including a pivoting ramp element hinged at one end. at least one piston and cylinder assembly supporting the pivoting ramp element, and a first flow control valve wherein the first flow control valve is operative to control the response of the pivoting ramp element.

Additionally in accordance with a preferred embodiment of the present invention the variable speed bump apparatus also includes a second flow control valve and wherein the first flow control valve is operative to control a motion of the pivoting ramp element when moving from an upper position towards a lower position and wherein the second flow control valve is operative to control the motion of the pivoting ramp element when returning towards said upper position.

Still further in accordance with a preferred embodiment of the present invention, the variable speed bump apparatus also includes an energy storage apparatus and a fluid and wherein the first flow control valve is interposed between the at least one piston and cylinder assembly and the energy storage apparatus and wherein the first flow control valve is operative to impart a first pressure drop to the fluid flowing therethrough when the pivoting ramp element moves from the upper position towards the lower position.

Still further in accordance with a preferred embodiment of the present invention the second flow control valve is interposed between the energy storage apparatus and the at least one piston and cylinder assembly and wherein the second flow control valve is operative to impart a second pressure drop to the fluid flowing therethrough when said pivoting ramp element moves towards the upper position.

Additionally in accordance with a preferred embodiment of the present invention the variable speed bump apparatus also includes a third flow control valve disposed between the piston and cylinder assembly and the energy storage apparatus and a control system wherein the control system is operative to selectively direct the flow of the fluid through the first flow control valve and the third flow control valve in response to an external signal.

Still further in accordance with a preferred embodiment of the present invention the variable speed bump assembly also includes a generator wherein the generator is operative to provide energy to the control system when a vehicle passes over the ramp assembly.

Further in accordance with a preferred embodiment of the present invention the response of the variable speed bump assembly is substantially proportional to the square of the speed of a vehicle passing over the ramp assembly.

Additionally in accordance with a preferred embodiment of the present invention the ramp assembly is coupled to a second complementary ramp assembly installed in a mirror image relationship.

BRIEF DESCRIPTION OF THE DRAWINGS

The present invention will be understood and appreciated from the following detailed description, taken in conjunction with the drawings, in which.

DETAILED DESCRIPTION OF THE INVENTION

Figure 1:
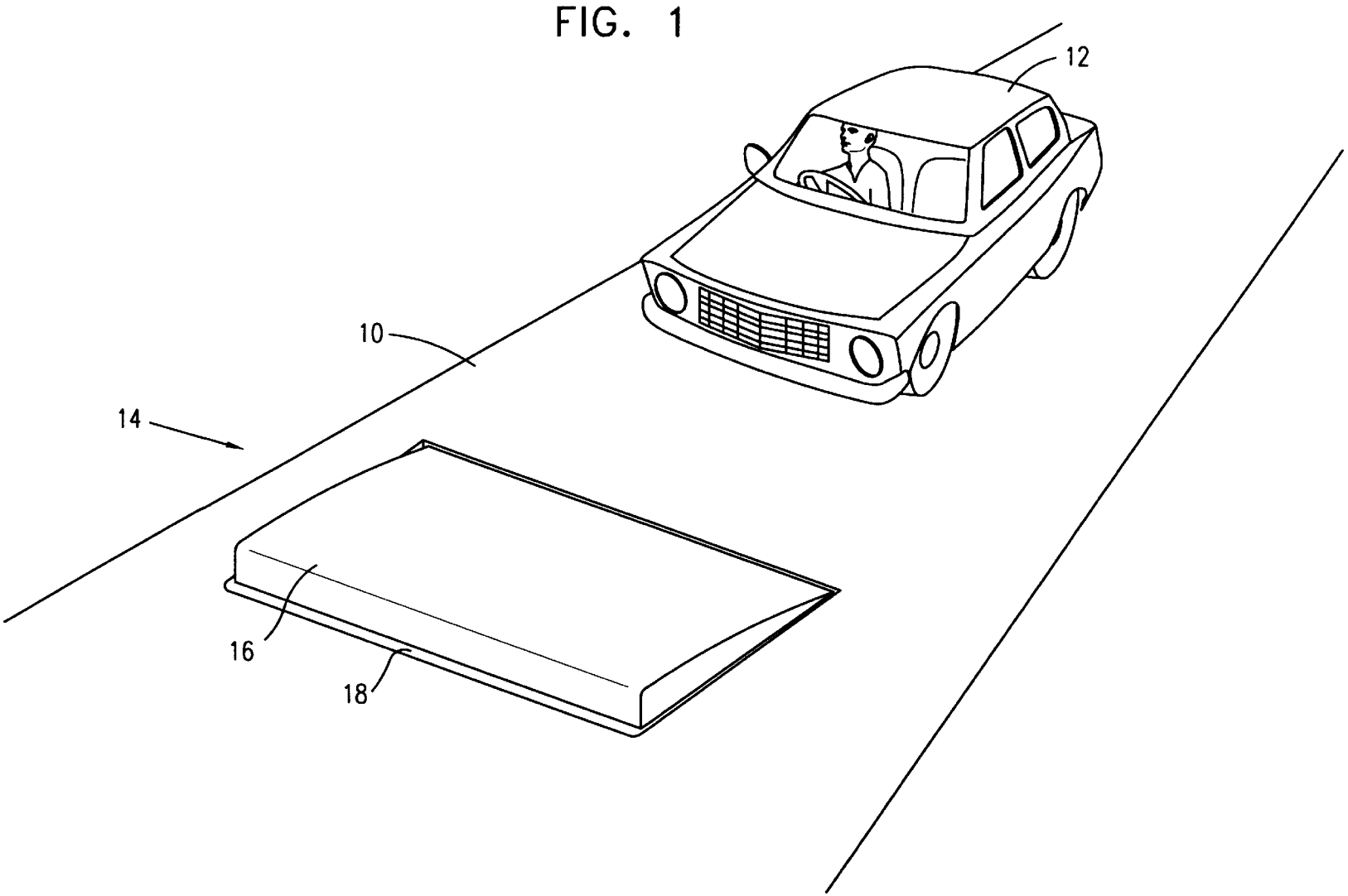
FIG. 1 is a simplified perspective drawing of variable speed bump apparatus constructed and operative in accordance with a preferred embodiment of the present invention as applied to a one way street.
Figure 2:
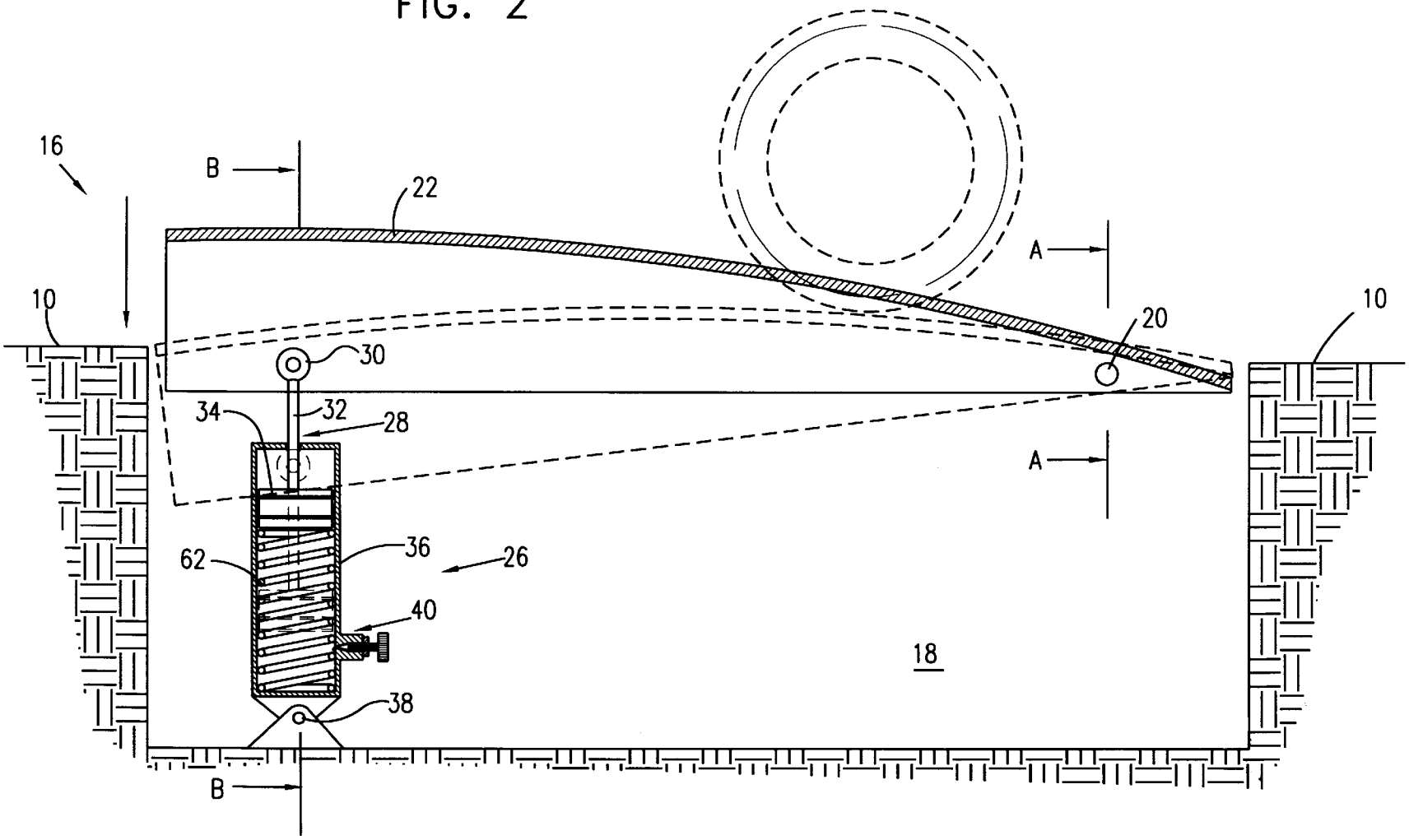
FIG. 2 is a cross section of the variable speed bump apparatus of FIG. 1.

Reference is now made to FIG. 1 which illustrates a variable speed bump 14 constructed and operative in accordance with a preferred embodiment of the present invention. As shown in FIG. 1, a one-way road 10 is provided with a variable speed bump generally denoted 14 The variable speed bump 14 comprises a ramp element 16 of a width substantially equal to the width of the road 10. In its upper position the ramp element forms a bulge over the level of the road 10 in a-manner similar to that of a conventional speed bump. The ramp element 16 is tiltable into a trench 18 formed in the road 10, as more clearly seen in FIG. 2. The ramp element 16 gradually slopes from the plane of the upper surface of the road 10, being hinged at its lowermost, upstream edge to a shaft 20. The ramp element 16 is thus adapted to pivot between the positions as shown in the solid and dashed lines in FIG. 2, depending whether a vehicle is moving over the ramp element as shown schematically.

Figure 3:
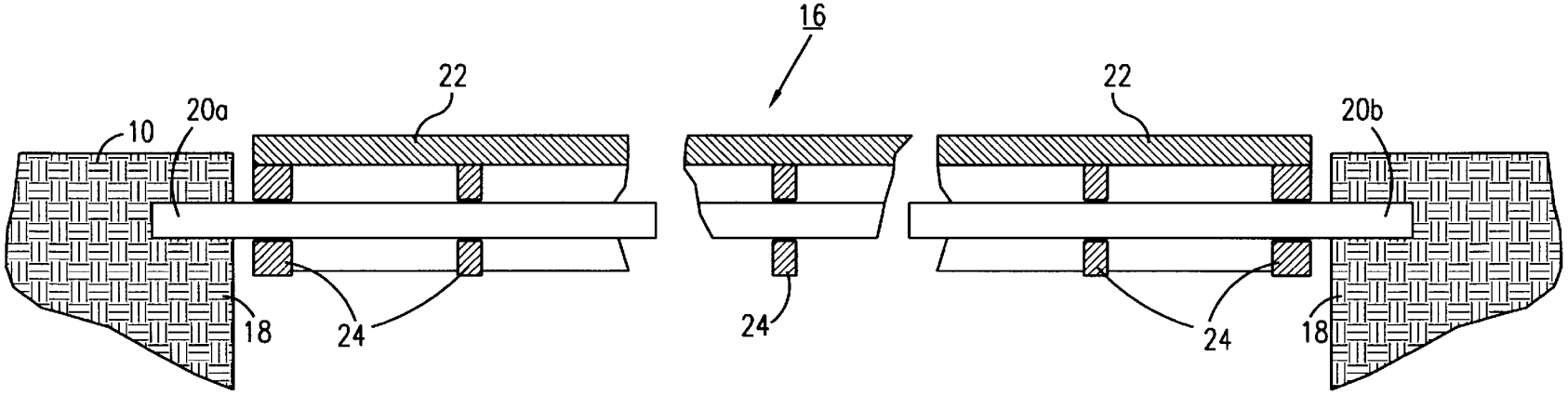
FIG. 3 is a section of the variable speed bump apparatus taken along line A—A of FIG. 2.

The ramp element 16 may be of metal having an upper curved cover 22 and a series of strengthening ribs 24, also serving to support the hinged shaft 20 as more clearly seen in FIG. 3.

As further seen in FIG. 3, the two ends 20*a* and 20*b* of the hinge shaft 20 are supported (by any suitable means) by the respective side walls of the trench 18, thus forming the pivotal support of the ramp element 16.

The opposite, projecting end of the ramp element 16 is supported by one or more cylinder and piston assemblies generally denoted 26. The cylinder and piston assembly 26 preferably comprises a pneumatic cylinder 36 and piston 28. Alternatively, the cylinder and piston assembly may comprise a hydraulic cylinder and piston.

Figure 4:
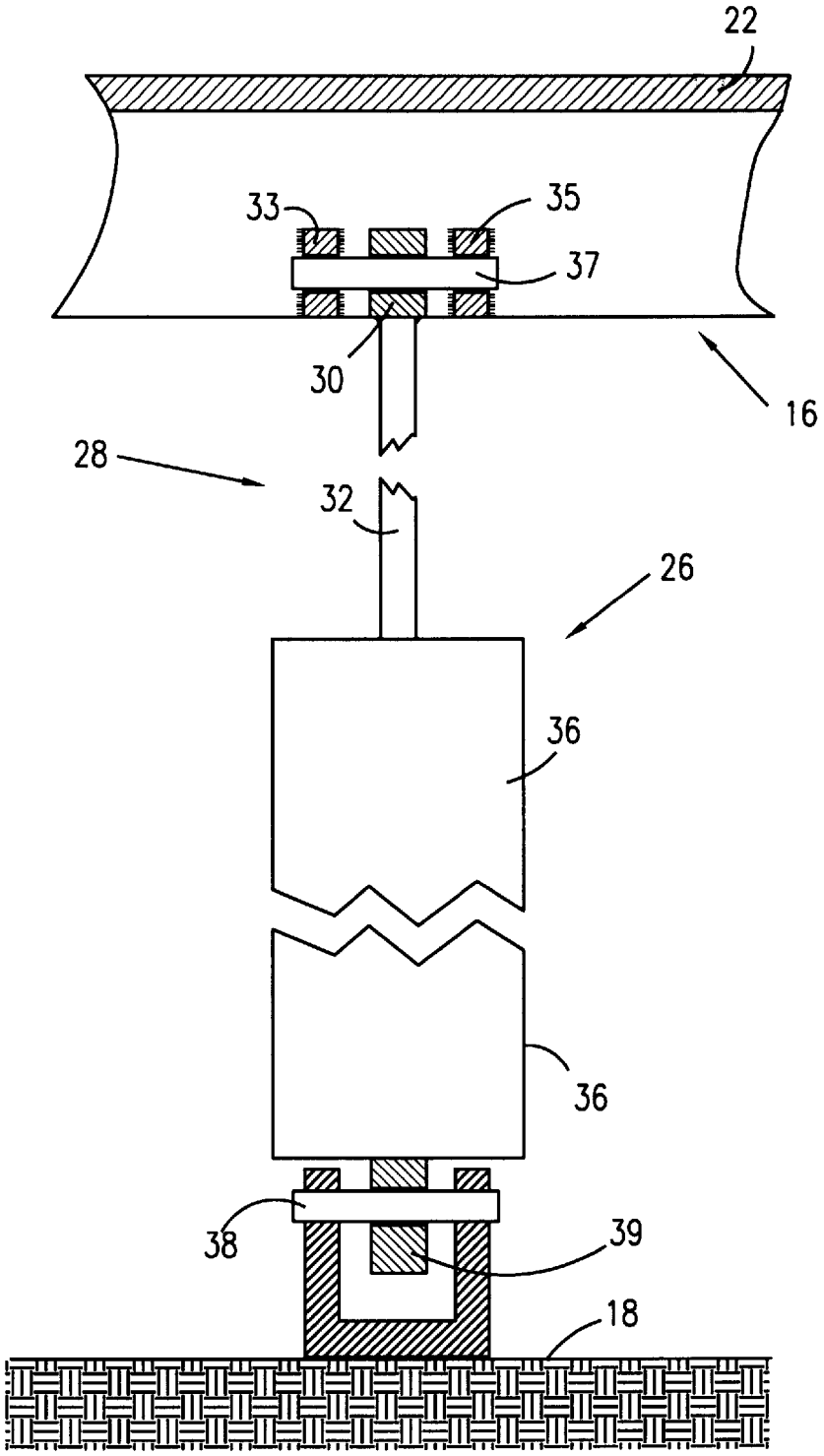
FIG. 4 is a section of the variable speed bump apparatus taken along line B—B of FIG. 2.

Piston 28 comprises a ring 30 of piston rod 32 (see FIGS. 4 and 5) and a piston 34 which is reciprocable within cylinder 36. The piston rod 32 is pivotally connected to the ramp element 16 by pin 37 and two ribs 33 and 35 which may be welded to the inner side of the cover 22. The cylinder 36 is also pivotally supported by pin 38 passing through ear 39 thus allowing the reciprocating movement of the piston 25 within the cylinder 26 in the manner described hereinbelow.

The cylinder 36 is provided with an adjustable air venting valve designated 40. The air venting valve 40 is operative to control the flow of air leaving and entering the cylinder 36.

Figure 5:
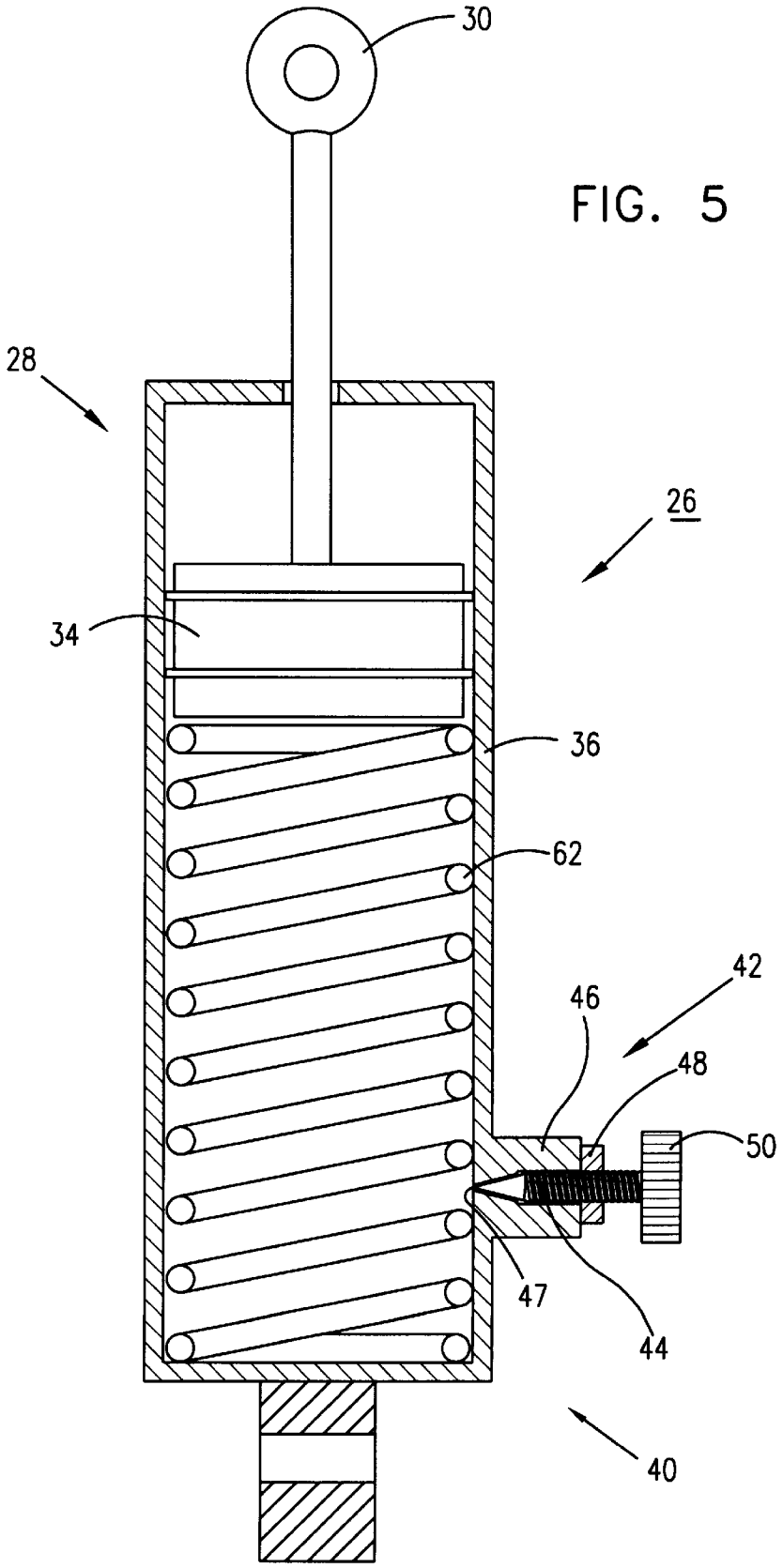
FIG. 5 is a simplified drawing showing details of a piston and flow control valve useful in speed bump apparatus of FIG. 1.

Reference is now made to FIG. 5 which is a simplified drawing showing details of the piston 26 and air venting valve 40 useful in the variable speed bump apparatus of FIG. 1.

As shown in FIG. 5, a needle flow control valve 42 is mounted in proximity to the bottom end of the cylinder 36 and comprises a needle valve member 44 threadable in a bushing 46 for closing against orifice 47. The position of the valve member 44 can be adjusted by first slackening a nut 48, turning the valve member 44 by means of a knurled hand wheel 50 and securing it in its selected position by tightening nut 48 against bushing 46.

It will be appreciated that air venting valve 42 may be any conventional commercially available adjustable needle valve.

Referring back to FIG. 2, it is shown that the cylinder 36 also comprises a return coil spring 62 acting against the piston 34, to return the ramp element 16 back to its upper or operative position after every operational stage, namely the passage of a vehicle wheel thereon. Since the rate of air evacuation from the cylinder 36 depends upon its passage through the orifice 47, the amount of cushioning effect of the ramp element 16 can be adjusted so that the ramp element 16 will withdraw softly, in a manner almost un-noticeable by the driver of the car 12, when the impact on the ramp element 16 is low, and if the impact is more vigorous—as it will be if the car speed is higher—the withdrawal of the ramp element 16 will take longer and the driver will sense the bumping effect that will warn him to slow down.

Figure 6:
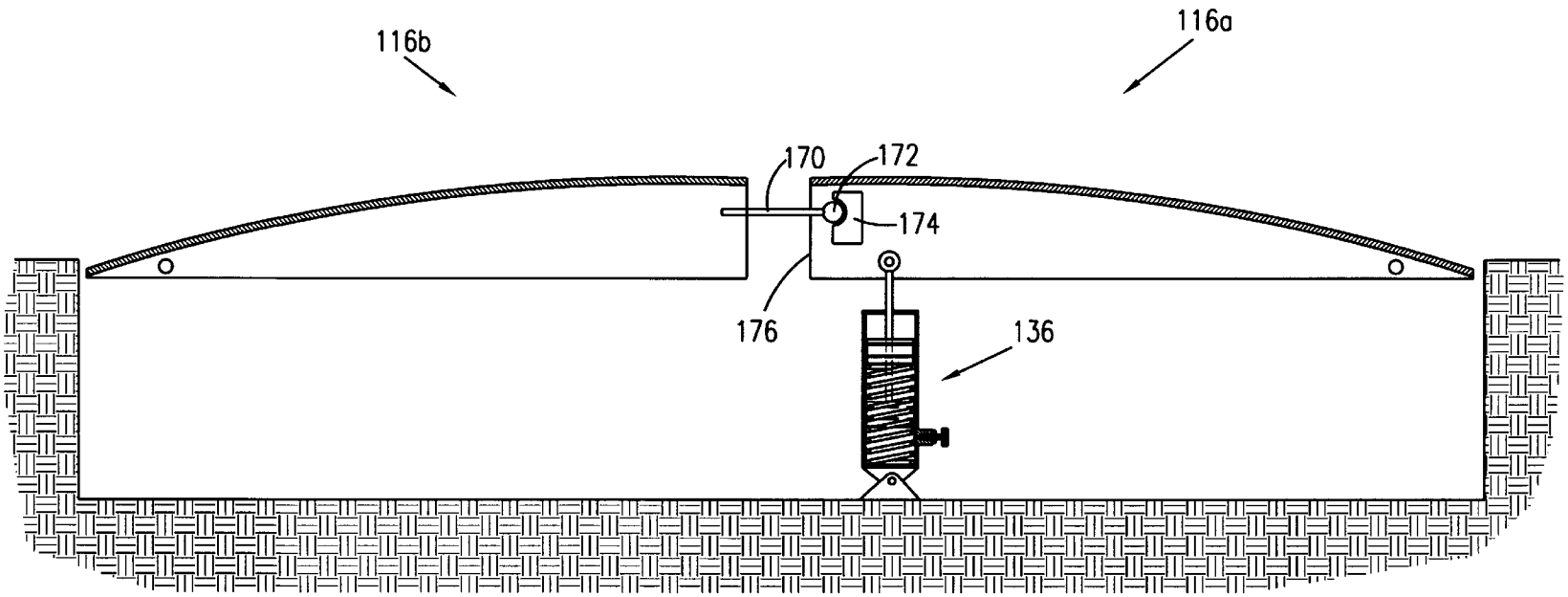
FIG. 6 is a simplified drawing of a variable speed bump apparatus constructed and operative in accordance with a preferred embodiment of the present invention as applied to a two way street.

Reference is now made to FIG. 6 which is a simplified perspective drawing of a variable speed bump apparatus constructed and operative in accordance with a preferred embodiment of the present invention as applied to a two way street;

As seen in FIG. 6, there is provided a pair of ramp elements 116*a* and 116*b* in a substantially mirror image configuration. Hence, the right-hand side of the device may be identical to that previously shown-, however, the second element 116*b* is not necessarily provided with a cushioning piston, but is hinged to the element 116*a*—by a plurality of pins or ribs 170 with semi-spherical bulge 172, received in a complementary recess 174 of the support 176 provided on the element 116*a*.

Any other suitable coupling arrangement of the elements 116*a* and 116*b* is of course applicable.

Figure 7A:
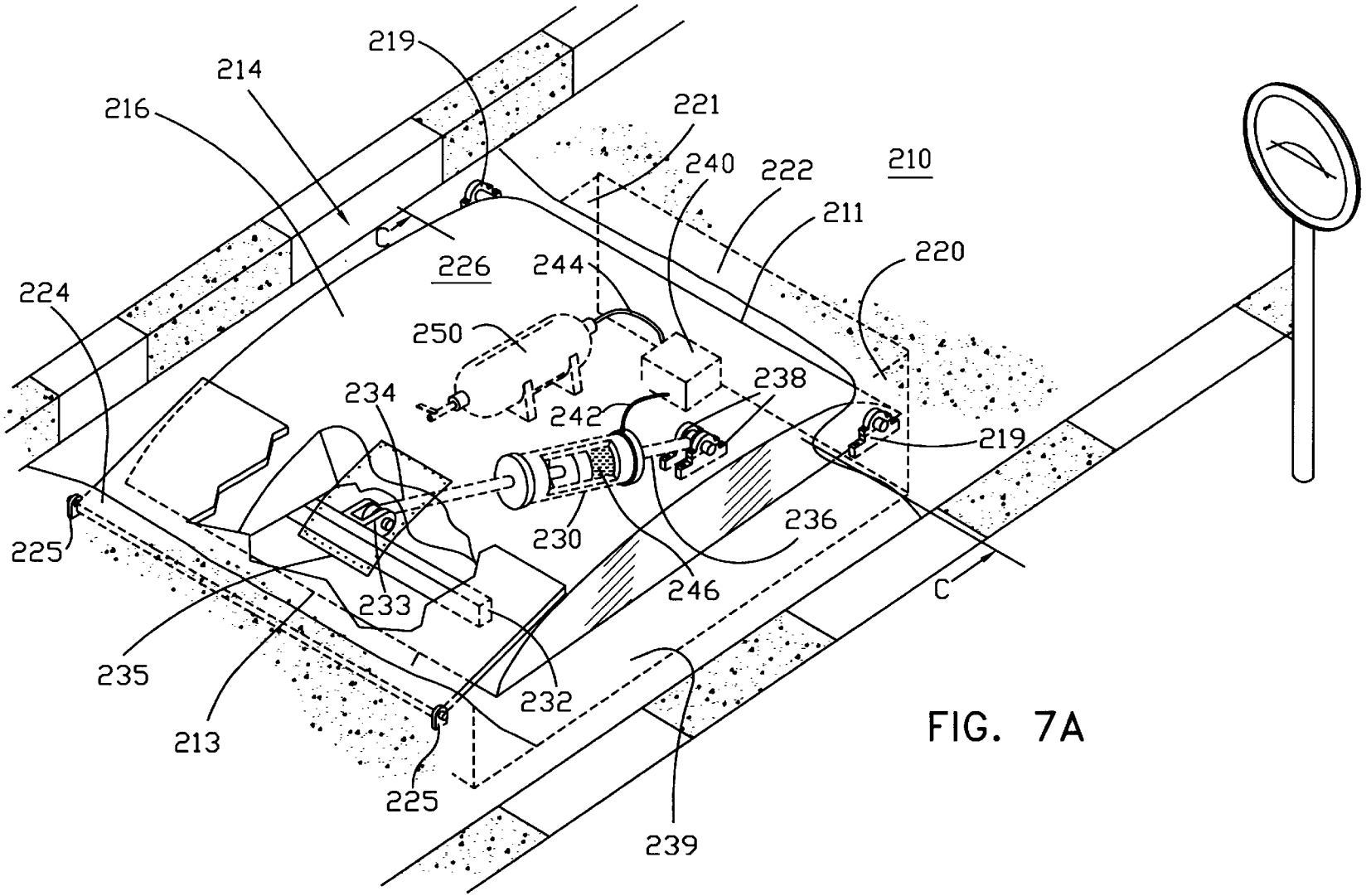
FIG. 7A is a simplified perspective drawing of a variable speed bump apparatus constructed and operative in accordance with another preferred embodiment of the present invention as applied to a two way street.

Reference is now made to FIG. 7A which is a simplified perspective drawing of a variable speed bump apparatus constructed and operative in accordance with yet another preferred embodiment of the present invention as applied to a two way street.

As shown in FIG. 7A, a two-way road 210 is provided with a variable speed bump designated generally by 214. The variable speed bump 214 comprises a ramp element 216 of a width substantially equal to the width of the road 210. The ramp element 216 may be similar to the ramp element 16 of FIG. 1. The ramp element 216 forms a bulge on the road 210 in a manner similar to that of a conventional speed bump. The ramp element 216 may be rotatably attached via ramp bearing 219 to a right hand side wall 220, in the sense of FIG. 7A, of a trench 222 formed in the road 210 at a hinged end 211. The ramp element 216 may also be rotatably attached via a second ramp bearing 219 to a left hand side wall 221, in the sense of FIG. 7A, of the trench 222. The side walls 220 and 221 may be made of concrete or any other suitable material. It will be appreciated that the ramp element 216 is tiltable into the trench 222 around ramp bearings 219. The ramp bearings 219 may comprise conventional Y-bearing units such as that manufactured by the SKF Group. Alternatively, ramp bearings 219 may be any suitable bearing.

The variable speed bump 214 also comprises an end flap 224 which is slidable over a top surface 226 of the ramp element 216 at a free end 213 of the ramp element 216. End flap 224 may be rotatably attached to the side walls 220 and 221 via flap bearings 225. The end flap 224 is operable to maintain contact with the top surface 226 of the ramp element 216. The flap bearings 225 may comprise conventional Y-bearing units such as that manufactured by the SKF Group. Alternatively, flap bearings 225 may be any suitable bearing.

The variable speed bump apparatus 214 also comprises a piston and cylinder assembly 230 which may be rotatably attached at a top end 234 to a support bracket 233. The support bracket 233 in turn may be fixedly attached to a bracket 232 which in turn may be fixedly attached to the underside of the top surface 226 of ramp element 216 in proximity to the free end 213. Alternatively, the top end 234 of the piston and cylinder assembly 230 may be rotatably attached at any convenient location on the ramp element 216. The support bracket 233 may also comprise a conventional self-aligning spherical plain bearing (not shown) such as that manufactured by the SKF Group.

The piston and cylinder assembly 230 may also be rotatably attached at a bottom end 236 to a bottom surface 239 of the trench 222 via a pair of lower piston support bearings 238. The bottom surface 239 may be made of concrete or any other suitable material. The lower piston support bearings 238 may be conventional Y-bearing units such as that manufactured by the SKF Group. Alternatively, the lower piston support bearings 238 may be any suitable bearing.

The piston and cylinder assembly 230 may comprise a conventional single-acting hydraulic piston.

The ramp element 216 may also comprise a hatch cover 235 which is preferably located in proximity to the support bracket 233. The hatch cover 235 is operable to allow access to the top end 234 of the piston and cylinder assembly 230 for assembly and servicing.

The variable speed bump apparatus 214 also comprises a control block 240 which is in fluid communication with the piston and cylinder assembly 230 via cylinder tubing 242. The control block 240 is also in fluid communication with a conventional accumulator 250 via accumulator tubing 244. The accumulator 250 may be a conventional bladder hydraulic accumulator. Alternatively, the accumulator 250 may be a conventional piston accumulator or an accumulator of any suitable type. The cylinder tubing 242 may comprise conventional flexible hydraulic tubing. The accumulator tubing 244 may comprise conventional flexible hydraulic tubing or any other suitable tubing.

The control block 240 may be a hydraulic control block and is operable to control the flow of a hydraulic fluid 246 between the piston and cylinder assembly 230 and the accumulator 250 as will be described hereinbelow. The fluid 246 may comprise water or any other suitable hydraulic medium such as a mixture of water and ethylene glycol to minimize the possibility of freezing, or any conventional hydraulic oil.

Figure 7B:
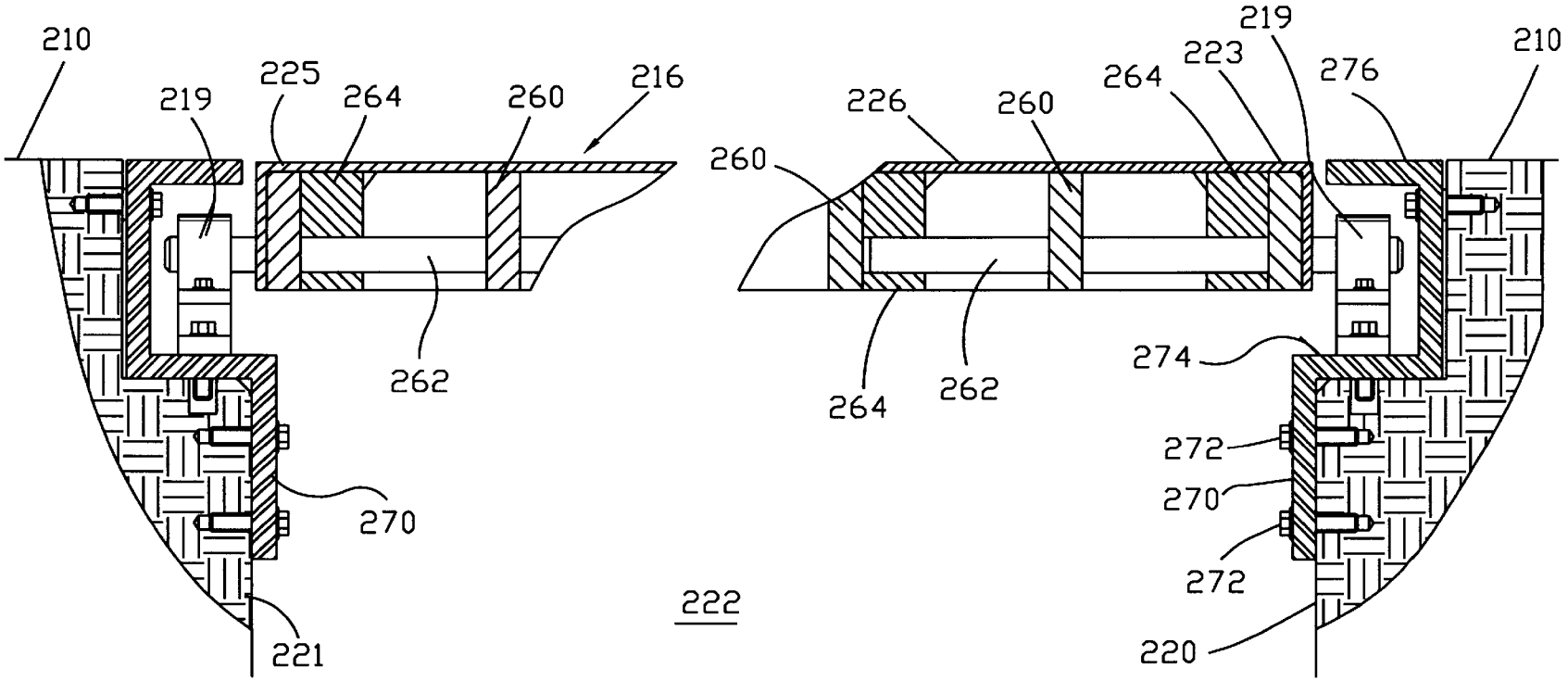
FIG. 7B is a cross section of the variable speed bump apparatus of FIG. 7A taken through line C—C of FIG. 7A.

Reference is now made to FIG. 7B which shows a cross section of the speed bump apparatus of FIG. 7A taken along line C—C. As seen in FIG. 7B, stiffening members 260 may be fixedly attached to the underside of top surface 226. The thickness and spacing of the stiffening members 260 and the thickness of the top surface 226 are such that the ramp element 216 is substantially rigid.

The ramp element 216 may also comprise rod support blocks 264 which are preferably fixedly attached to ,he underside of the top surface 226 in proximity to a right hand end 223 of the ramp element 216. The rod support blocks 264 may also be fixedly attached to the stiffening members 260. Rod support blocks 264 may also be fixedly attached to the underside of the top surface 226 in proximity to a left hand end 225 of the ramp element 216.

The ramp element 216 may also comprise rod elements 262 fixedly attached to the rod support blocks 264 in proximity to the right hand edge 223 and to the left hand edge 225. It will be appreciated that the rod element 262 in proximity to the right hand edge 223 is substantially collinear with the rod element 262 in proximity to the left hand edge 225. It will also be appreciated that the rod elements 262 are substantially rigidly attached to the ramp element 216.

A hooked shaped bracket 270 may be fixedly attached to each of the side walls 220 and 221 of the trench 222 by screws 272. The ramp bearing 219 in turn may be fixedly attached to a support surface 274 of the hooked shaped bracket 270. The ramp bearing 219 is disposed to receive the rod element 262.

The hooked shaped bracket 270 also comprises an upper surface 276 which is preferably substantially coplanar with the road 210. The upper surface 276 substantially fills the space between the ramp element 216 and the road 210.

It will be appreciated that a second hooked shape bracket 270 may be fixedly attached to the left hand side wall 221 in substantially the same manner, as illustrated in FIG. 7B.

It will also be appreciated that the ramp element 216 is substantially free to rotate about the ramp bearings 219. It will also be appreciated that the ramp element 216 is tiltable into the trench 222.

Figure 8A:
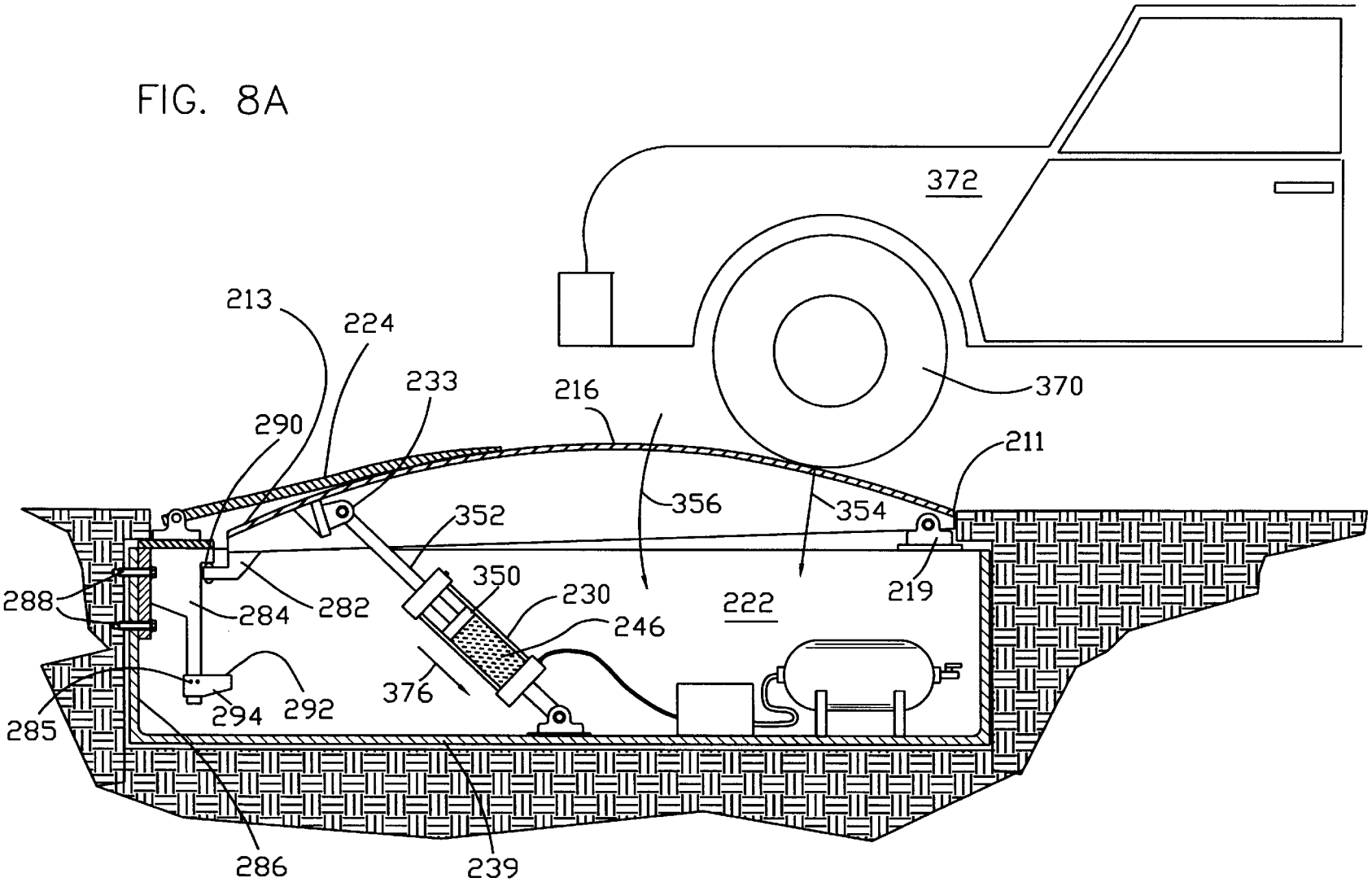
FIG. 8A is a simplified side view of the variable speed bump apparatus of FIG. 7A in an upper position.
Figure 8B:
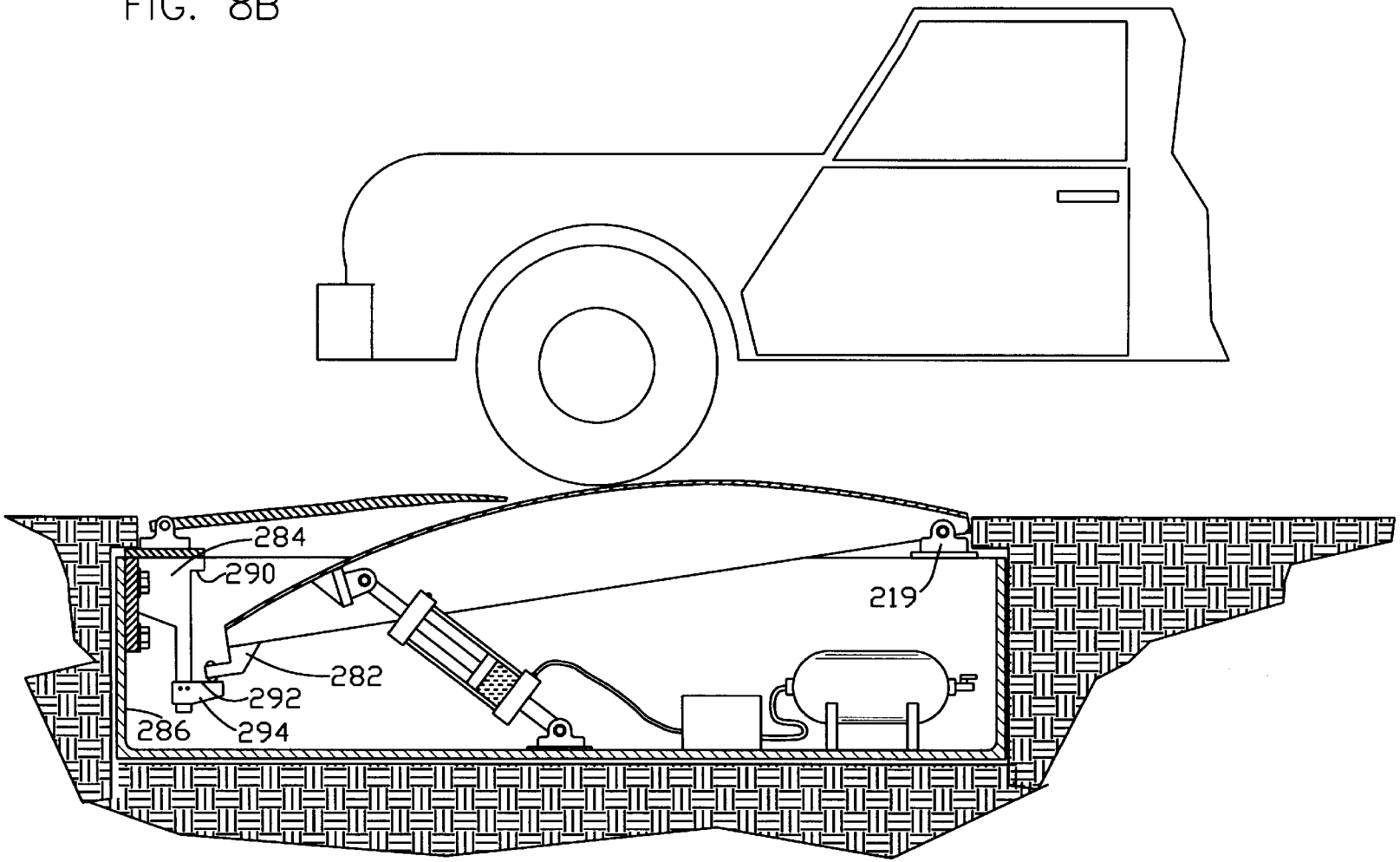
FIG. 8B is a simplified side view of the variable speed bump apparatus of FIG. 7A in a lower position.

Reference is now made to FIG. 8A which is a simplified side view of the variable speed bump apparatus of FIG. 7A in an upper position. Reference is also made to FIG. 8B which is a simplified side view of the variable speed bump apparatus of FIG. 7A in a lower position.

As can be seen in FIG. 8A, the ramp element 216 is hinged at the hinged end 211 by the ramp support bearings 219 and is supported in proximity to the free end 213 by the piston and cylinder assembly 230.

A motion limiter 282 may be fixedly attached adjacent the free end 213 of the ramp element 216 and extend therefrom in the direction of a front wall 286 of the trench 222. A motion limiting bracket 284 may be fixedly attached to the front wall 286 by screws 288. The motion limiting bracket 284 is disposed to receive the motion limiter 282 and is operative to limit the motion of the ramp element 216 as will be described hereinbelow.

The motion limiting bracket 284 may comprise an upper limiting surface 290 and a lower motion limiter 294. The lower motion limiter 294 may be fixedly attached to a number of positions of the motion limiting bracket 284 by screws 285 and may comprise a lower limiting surface 292.

It will be apparent that the motion limiter 282 and the motion limiting bracket 284 are operative to limit the travel of the ramp element 216 between the upper position as shown in FIG. 8A and the lower position as shown in FIG. 8B.

The piston and cylinder assembly 230 also comprises a piston 350 and a piston rod 352 which is rotatably attached to the ramp assembly 216 at the support bracket 233.

The front wall 286 may be comprised of concrete or any other suitable material.

Figure 9A:
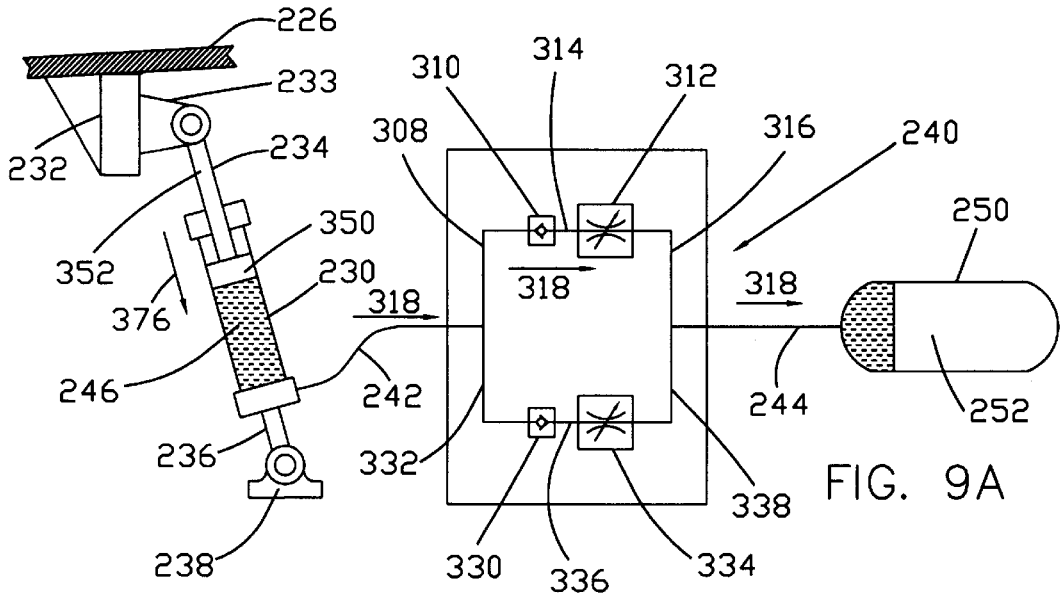
FIG. 9A is a simplified schematic drawing of a hydraulic control block useful in the speed bump apparatus of FIG. 7A in a configuration corresponding to the upper position.

Reference is now also made to FIG. 9A which is a simplified schematic drawing of the hydraulic control block 240 useful in controlling the variable speed bump apparatus of FIG. 7A. The configuration of the hydraulic control block in FIG. 9A corresponds to the upper position of the ramp element 216 as shown in FIG. 8A.

As seen in FIG. 9A, the hydraulic control block 240 comprises as lowering check valve 31 C in fluid communication with the piston and cylinder assembly 230 via the cylinder tubing 242 and connecting tube 308. The lowering check valve 310 is also in fluid communication with a lowering flow control valve 312 via connecting tube 314. The lowering flow control valve 312 is in turn in fluid communication with the accumulator 250 via connecting tube 316 and the accumulator tube 244.

As is known in the an, the various connecting tubes may be conventional hydraulic tubing and are preferably made of steel. Alternatively, the connecting tubes may be made of copper or any other suitable material.

The lowering check valve 310 may be a conventional check valve such as the Series C check valve manufactured by the Parker Hannifin Corporation of Elyria, Ohio. The lowering check valve 310 is operative to allow the flow of the fluid 246 from the piston and cylinder assembly 230 through the lowering flow control valve 312 and to the accumulator 250 as indicated by the arrow 318, and to prevent the flow of the fluid 246 from the accumulator 250 to the piston and cylinder assembly 230.

The lowering flow control valve 312 may be a conventional adjustable flow control valve such as a Series N needle valve manufactured by the Parker Hannifin Corporation of Elyria, Ohio. The flow control, valve 312 is operative to restrict the flow of the fluid 246 thereby imparting a pressure drop across the flow control valve 312 which is substantially proportional to the square of the flow rate of the fluid 246 therethrough.

The hydraulic control block 240 also comprises a raising check valve 330 in fluid communication with the piston and cylinder assembly 230 via the cylinder tubing 242 and connecting tube 332. The raising check valve 330 is also in fluid communication with a raising flow control valve 334 via connecting tube 336. The raising flow control valve 334 is in turn in fluid communication with the accumulator 250 via connecting tube 338 and the accumulator tube 244.

The raising check valve 330 may be a conventional check valve such as the Series C check valve manufactured by the Parker Hannifin Corporation of Elyria, Ohio. The raising check valve 330 is operative to allow the flow of the fluid 246 from the accumulator 250 to the piston and cylinder assembly 230 through the raising flow control valve 334 and to prevent the flow of the fluid 246 from the piston and cylinder assembly 230 to the accumulator 250.

The raising flow control valve 334 may be a conventional adjustable flow control valve such as a Series N needle valve manufactured by the Parker Hannifin Corporation of Elyria, Ohio. The flow control valve 334 is operative to restrict the flow of the fluid 246 thereby imparting a pressure drop across the flow control valve 334 which is substantially proportional to the square of the flow rate of the fluid 246 therethrough.

It will be appreciated therefore that the piston and cylinder assembly 230 and the accumulator 250 are in fluid communication through the hydraulic control block 240 via the lowering check valve 310, the lowering flow control valve 312 and the hydraulic tubes 242, 308, 314, 316 and 244 for flow in the direction from the piston and cylinder assembly 230 to the accumulator 250. It will also be appreciated that the accumulator 250 is in fluid communication with the piston and cylinder assembly 230 through the hydraulic control block 240 via the raising check valve 330, the raising flow control valve 334 and the hydraulic tubes 244, 338, 336, 332 and 242 for flow in the direction from the accumulator 250 to the piston and cylinder assembly 230.

It will also be appreciated that if the pressure of the fluid 246 in the piston and cylinder assembly 230 is greater than the pressure of the fluid 246 in the accumulator 250, the fluid 246 will flow from the piston and cylinder assembly 230 to the accumulator 250.

It will also be appreciated that if the pressure of the fluid 246 in the accumulator 250 is greater than the pressure of the fluid 246 in the piston and cylinder assembly 230, the fluid 246 will flow from the accumulator 250 to the piston and cylinder assembly 230.

As is known in the art, the accumulator 250 may be may be precharged with a gas 252 such as nitrogen or any other suitable gas. As is also know in the art, the pressure of the fluid 246 in the accumulator 250 is substantially equal to the pressure of the gas 252. The precharge pressure $P_{precharge}$ of the gas 252 is such that the pressure of the fluid 246 in the piston and cylinder assembly 230 is sufficiently high so that the force of the fluid 246 on the piston 350 and the piston rod 352 overcomes the weight of the ramp assembly 216 and forces the motion limiter 282 against the upper motion limiting surface 290, as seen in FIG. 8A in the upper position of the ramp assembly 216.

Operation of the variable speed bump apparatus 214 is now described with reference to FIGS. 8A and 9A.

When the front wheel 370 of a vehicle 372 rides over the hinged end 211 of the ramp assembly 216, the weight of the vehicle exerts a wheel force generally in a direction perpendicular to the upper surface 226 of the ramp assembly 216 as indicated by the arrow 354. It will be appreciated that as the vehicle 372 travels towards the free end 213 of the ramp element 216, the pressure of the fluid 246 in the piston and cylinder assembly 230 will increase. This increase in pressure causes the hydraulic fluid 246 to flow from the piston and cylinder assembly 230 to the accumulator 250 via the lowering check valve 310 and the lowering flow control valve 312 in the direction of the arrow 318, thereby imparting a tilting motion of the ramp assembly around the ramp bearing 219 as indicated by the arrow 356.

Three cases of vehicle velocity will be considered: a low vehicle velocity which may be less than about 10 km/hr, an intermediate vehicle velocity which may be in the range from about 10 km/hr to about 20 km/hr, and a high vehicle velocity which may be above about 20 km/hr. It will be appreciated that these velocities are by way of example only and is intended to describe the overall response of the variable speed bump 214 to different vehicle velocities.

If the velocity of the vehicle 372 is in the low speed range, then the angular velocity of the ramp assembly 216 around the ramp bearing 219 is low and the velocity of the piston 350 in the direction indicated by the arrow 376 is low. The resulting rate of flow of the fluid 246 from the piston and cylinder assembly 230 through the lowering flow control valve 312 is also low The pressure drop imparted by the lowering flow control valve 311 is also low so that the pressure of the fluid 246 in the piston and cylinder assembly 230 is not substantially effected by the pressure drop through the flow control valve 312.

It will be appreciated therefore that when the velocity of the vehicle 372 is in the low range, the ramp assembly 216 will tilt into the trench 222 without substantially impeding the motion of the vehicle 370. It will also be appreciated that the ramp assembly 216 may rotate around the ramp bearing 219 until the motion limiter 282 reaches the lower motion limiting surface 292.

If the velocity of the vehicle 372 is in the intermediate speed range, then the angular velocity of the ramp assembly 216 around the ramp bearing 219 is moderate and the velocity of the piston 350 in the direction indicated by the arrow 376 is moderate. The resulting rate of flow of the fluid 246 from the piston and cylinder assembly 230 through the lowering flow control valve 312 is also moderate. The pressure drop imparted by the lowering flow control valve 312 is such that the pressure of the fluid 246 in the piston and cylinder assembly 230 is moderately effected by the pressure drop through the flow control valve 312.

It will be appreciated therefore that when the velocity of the vehicle 372 is in a moderate speed range, the ramp assembly 216 will moderately impede the motion of the vehicle 372.

If the velocity of the vehicle 372 is in the high speed range, then the angular velocity of the ramp assembly 216 around the ramp bearing 219 is high and the velocity of the piston 350 in the direction indicated by the arrow 376 is high. The resulting rate of flow of the fluid 246 from the piston and cylinder assembly 230 through the lowering flow control valve 312 is also high. The pressure drop imparted by the lowering flow control valve 312 is also high so that the pressure of the oil 246 in the piston and cylinder assembly 230 is substantially effected by the pressure drop through the flow control valve 312.

It will be appreciated therefore that when the velocity of the vehicle 372 is in a high range, the ramp assembly 216 will substantially impede the motion of the vehicle 372.

It will be appreciated by one skilled in the art that the impeding effect of ramp assembly 216 will increase substantially as the square of the speed of vehicle 372. It will also be appreciated by one skilled in the art that the setting of the lowering flow control valve 312 may be adjusted to achieve substantially any desired characteristic.

For example, if the setting of the lowering flow control valve 312 is set to a low value such as ⅕ of the full opening, then the ramp assembly 216 will have a relatively stiff characteristic.

As another example, if the setting of the lowering flow control valve 312 is set to an intermediate value such as ½ of the full opening, then the ramp assembly 216 will have a moderate characteristic.

As still another example, if the setting of the lowering flow control valve 312 is set to a high value such as ¾ of the full opening, then the ramp assembly 216 will have a soft characteristic.

It will be appreciated that the terms 'stiff characteristic', 'soft characteristic' and 'moderate characteristic' are intended to describe the general performance of the variable speed bump apparatus 214 in response to different vehicle velocities.

If the lowering flow control valve is fully closed, then the ramp assembly 216 will not be responsive to the velocity of the vehicle 370 and the speed bump apparatus will operate as a conventional speed bump.

Figure 9B:
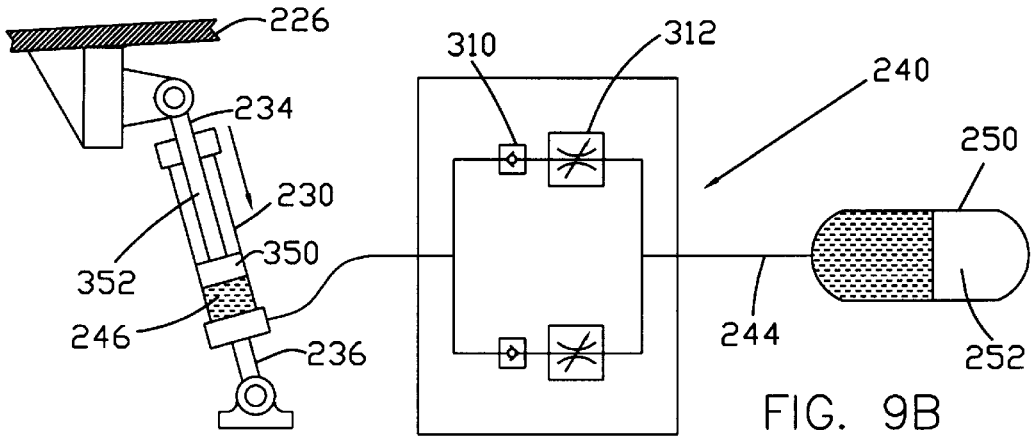
FIG. 9B is a simplified schematic drawing of the hydraulic control block in a configuration corresponding to the lower position.

Reference is now also made to FIG. 9B, which is a simplified schematic drawing of the hydraulic control block 240 in a configuration corresponding to the lower position of the ramp assembly 216 as shown in FIG. 8B. As seen in FIG. 9B, the piston 350 has traveled towards the lower end 236 and a substantial portion of the fluid 246 has been transferred through the hydraulic control block 240 to the accumulator 250 via the lowering flow control valve 312. The gas 252 in the accumulator 250 has been compressed thereby to a high pressure value $P_{high}$. The volume of the accumulator 250 and the precharge pressure $P_{precharge}$ are such that the value of $P_{high}$ may be in the range between 1.2 times that of $P_{precharge}$ and 2 times that of $P_{precharge}$ and preferably about 1.5 times that of $P_{precharge}$.

It will be appreciated that the lower position may only be reached if the velocity of the vehicle is in the low speed range.

Figure 8C:
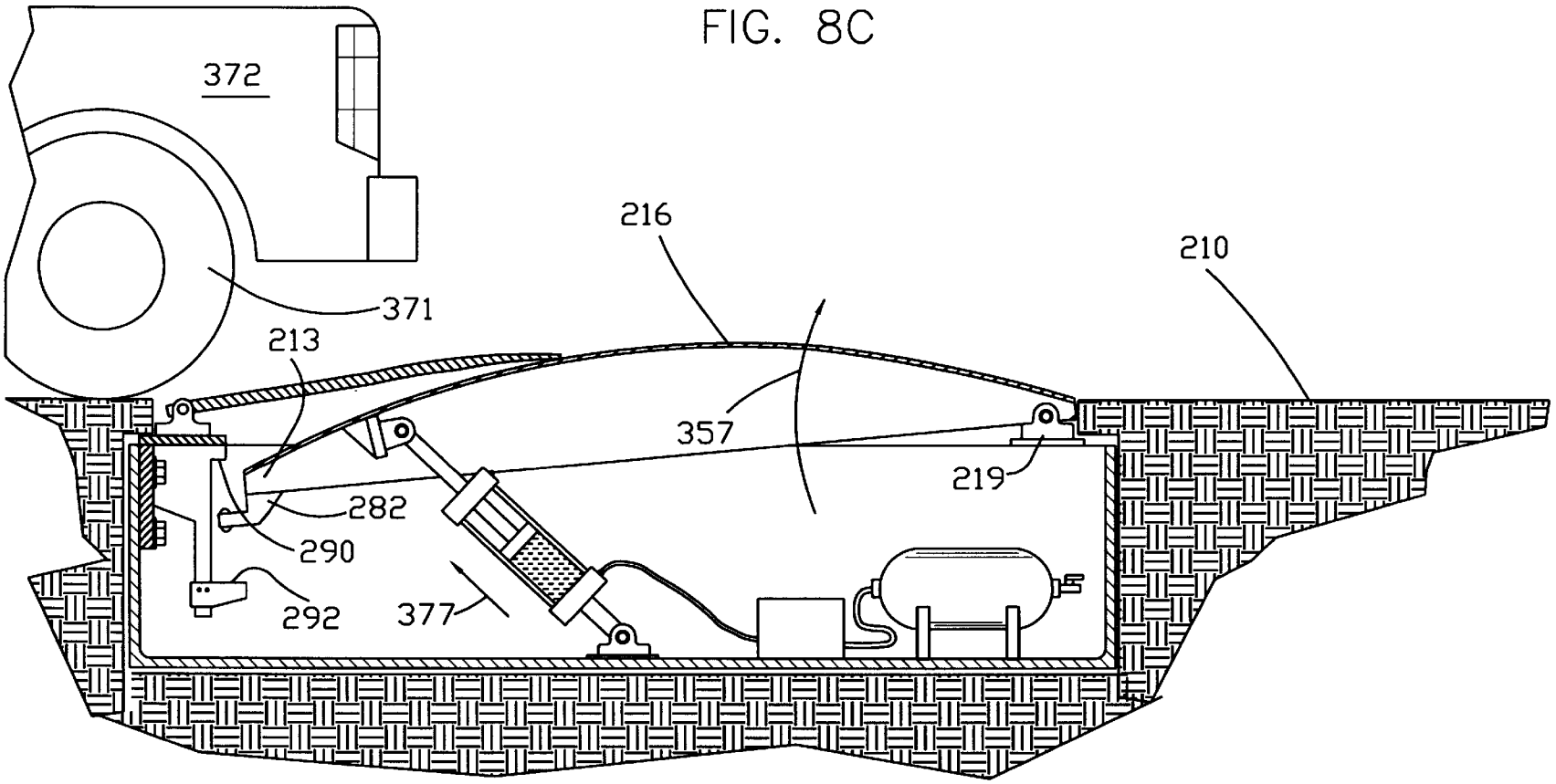
FIG. 8C is a simplified side view of the variable speed bump apparatus of FIG. 7A in an intermediate position returning to the upper position.

Reference is now made to FIG. 8C, which is a simplified side view of the variable speed bump apparatus of FIG. 7A in an intermediate position returning to the upper position. Reference is also made FIG. 9C which is a simplified schematic drawing of the hydraulic control block 240 in a configuration corresponding to the intermediate position shown in FIG. 8C.

As seen in FIG. 8C, a rear wheel 371 of the vehicle 372 has passed over the hinged end 213 of the ramp assembly 216 and the weight of the vehicle is no longer supported by the piston and cylinder assembly 230. It will be appreciated therefore that the pressure of the gas 252 in the accumulator 250 imparts a pressure to the fluid 246 which is higher than the pressure of the fluid 246 in the piston and cylinder assembly 230.

It will be appreciated therefore that the fluid 246 will flow from the accumulator 250 to the piston and cylinder assembly 230 via the raising flow control valve 334 and the raising check valve 330, as shown by the arrows 380. It will also be appreciated that the piston 350 and the piston rod 352 will move in the direction indicated by the arrow 377 and that the ramp assembly 216 will rotate in the direction of the arrow 357, thereby returning the ramp assembly 216 to the upper position.

The setting of the raising flow control valve 334 is such that a return time required for the ramp assembly to move from the lower position as shown in FIG. 8B to the upper position as shown in FIG. 8A is in the range from about 1 to about 10 seconds and is preferably about 2 seconds.

It will be appreciated by one skilled in the art that the smaller the opening of the raising flow control valve 334, the longer will be the return time. It will also be appreciated that the greater the opening of the raising flow control valve 334, the shorter will be the return time.

It will be appreciated by one skilled in the art that the setting of the lowering flow control valve 312 substantially controls the movement of the ramp assembly 216 from the upper position towards the lower position when the vehicle 372 moves over the ramp assembly 216 and the setting of the raising flow control valve 334 substantially controls the return of the ramp assembly 216 towards the upper position after the vehicle 372 passes over the ramp assembly 216.

It will also be appreciated that the response of the variable speed bump 214 when a vehicle moves in the direction from the free end 213 to the hinged end 211 will be substantially the same as the response when the vehicle moves from the hinged end 211 to the free end 213.

Figure 10:
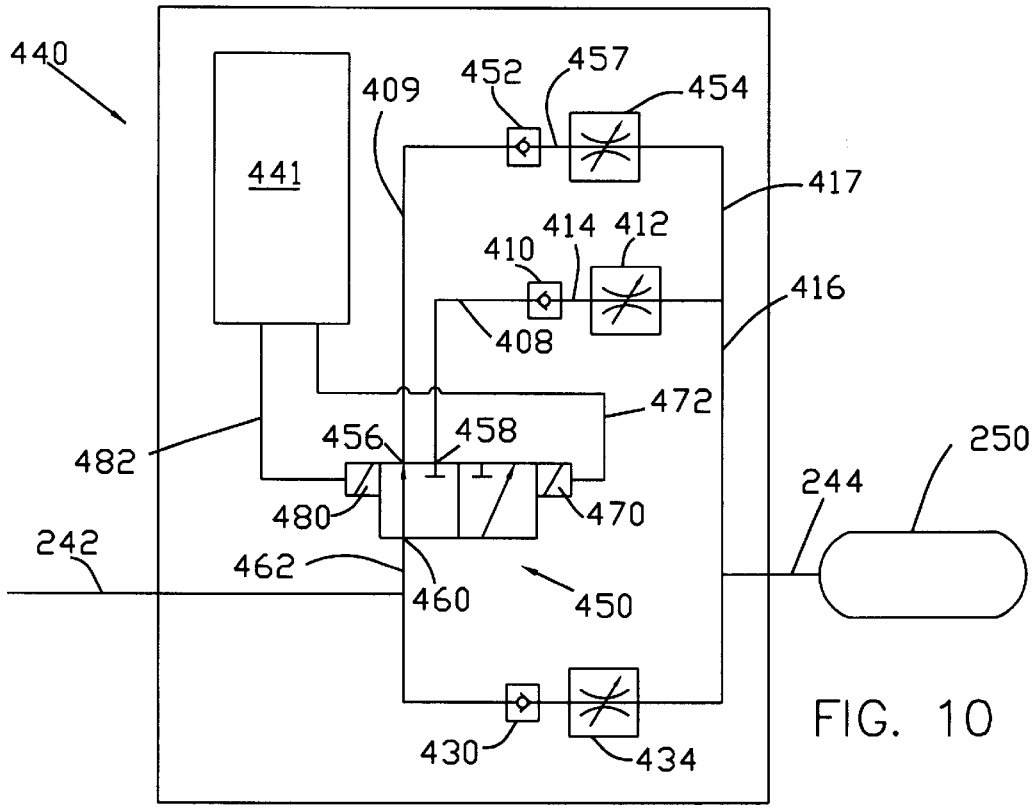
FIG. 10 is a simplified schematic drawing of another hydraulic control block useful in the speed bump apparatus of FIG. 7A.
Figure 11:
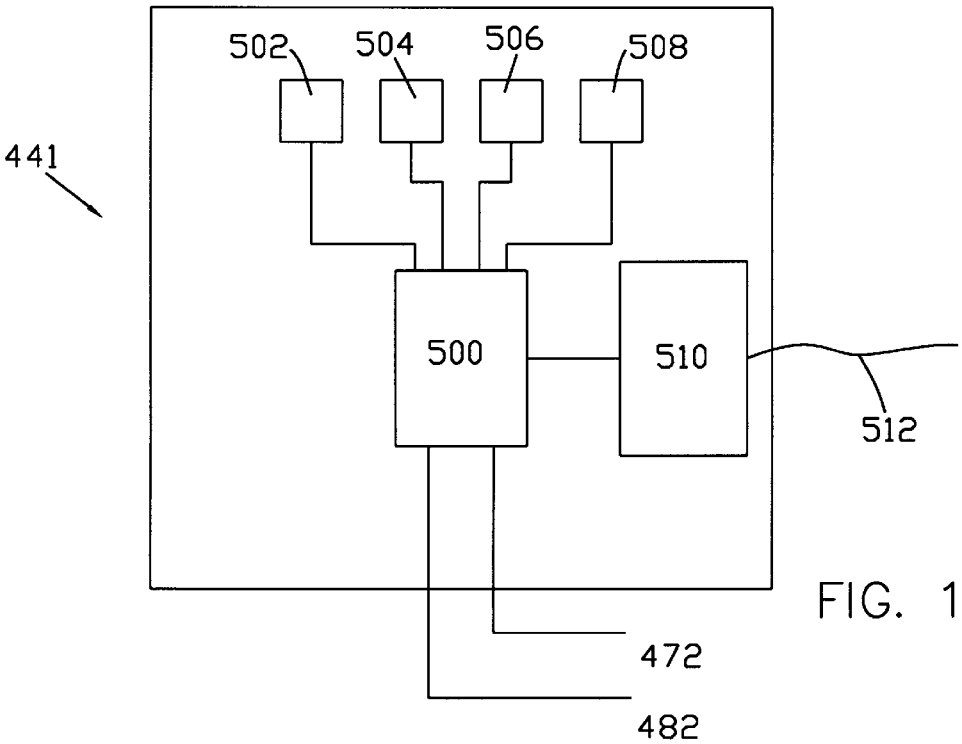
FIG. 11 is a simplified block drawing in block diagram form of an electronic controller useful in controlling the hydraulic control block of FIG. 10.

Reference is now made to FIG. 10 which is a simplified schematic drawing of another hydraulic control block useful in the speed bump apparatus of FIG. 7A. The control block 440 may be similar to that shown in FIG. 9A, identical or equivalent components being represented in FIG. 10 by the same reference numerals with the prefix "4".

The hydraulic control block 440 differs from the hydraulic control block of FIG. 9A in that the hydraulic control block 440 also comprises an electronic controller 441. The electronic controller 441 is described hereinbelow with reference to FIG. 12.

The hydraulic control block 440 also comprises a selection valve generally indicated by 450. The selection valve 450 may be a conventional four way, two position directional flow control valve such as Type WE6 manufactured by Mannesmann Rexroth GmbH of Lohr am Main, Germany. Alternatively, the selection valve 450 may be any other suitable directional flow control valve.

The selector valve 450 comprises an inlet port 460 in fluid communication with the cylinder tubing 242 via connecting tube 462. The selector valve 450 also comprises a first outlet port 458 and a second outlet port 456. The selector valve 450 also comprises a first solenoid 470 and a second solenoid 480.

The selector valve 450 is operative, in response to signals from the electronic controller 441 to selectively direct the flow of fluid 246 from the inlet port 460 to the first outlet port 458 or to the second outlet port 456. Thus for example, if the first solenoid 470 is activated by the controller 441, the flow of fluid 246 is directed from the inlet port 460 to the first outlet port 458. Similarly, if the second solenoid 480 is activated by the controller 441, the flow of fluid 246 is directed from the inlet port 460 to the second outlet port 456.

The hydraulic control block 440 also comprises a first lowering check valve 410 and a first lowering flow control valve 412 in fluid communication therebetween via connecting tube 414. The first lowering check salve 410 is also in fluid communication with the first output port 458 of the selector valve 450 via connecting tube 408. The first flow control valve 412 is also in fluid communication with the accumulator 250 via connecting tube tubing 416 and the accumulator tube 244.

The hydraulic control block 440 also comprises a second lowering check valve 452 and a second lowering flow control valve 454 in fluid communication therebetween via a connecting tube 457. The second lowering check valve 452 is also in fluid communication with the second output port 456 of the selector valve 450 via connecting tube 409. The second flow control valve 454 is also in fluid communication with the accumulator 250 via connecting tubes 417, 416 and the accumulator tube 244.

The second lowering check valve 452 and the second lowering flow control valve 454 may be similar to the first lowering check valve 410 and the first flow control valve 412.

The first lowering flow control valve 412 may be set in the range ⅕ to ½ and preferably about ⅓ of the full opening to provide a stiff response of the ramp assembly 216. The second lowering control valve 454 may be set in the range from about ½ to about ⅘ and preferably about ⅔ of the full opening to provide a soft response of the ramp assembly 216.

It will be appreciated that the first output port 458 of the selector valve 450 is in fluid communication with the accumulator 250 via the first lowering check valve 410, the first lowering flow control valve 412 and the connecting tubes tubing 408, 414, 416 and the accumulator tube 244.

It will be also be appreciated that the second output port 456 of the selector valve 450 is in fluid communication with the accumulator 250 via the second lowering check valve 452, the second lowering flow control valve 454 and the connecting tubes 409, 457, 417, 416 and the accumulator tube 244.

The electronic controller 441 is in electrical communication with the first solenoid 470 via a first solenoid control wire 472. The electronic controller 441 is also in electrical communication with the second solenoid 480 via a second solenoid control wire 482.

The selector valve 450 is operative to selectively direct the flow of the fluid 246 from the piston and cylinder assembly 230 to the accumulator 250 via the first lowering check valve 410 and the first lowering flow control valve 412 in response to a first control signal from the controller 440.

The selector valve 450 is also operative to selectively direct the flow of the fluid 246 from the piston and cylinder assembly 230 to the accumulator 250 via the second lowering check valve 452 and the second lowering flow control valve 454 in response to a second control signal from the controller 440.

The electronic controller 441 is operative to send the first control signal to the first solenoid 470 via the first solenoid control wire 472. The controller 440 is also operative to send the second control signal to the second solenoid via the second solenoid control wire 482.

The electronic controller 441 is also operative to send the first control signal and the second control signal in response to an external signal. The external signal may comprise signals from the group comprising sound waves, radio waves and radar signals. Alternatively, the external signal may comprise any other suitable signal. The electronic controller 441 is also operative to send the first control signal and the second control signal in response to a time signal.

Figure 9C:
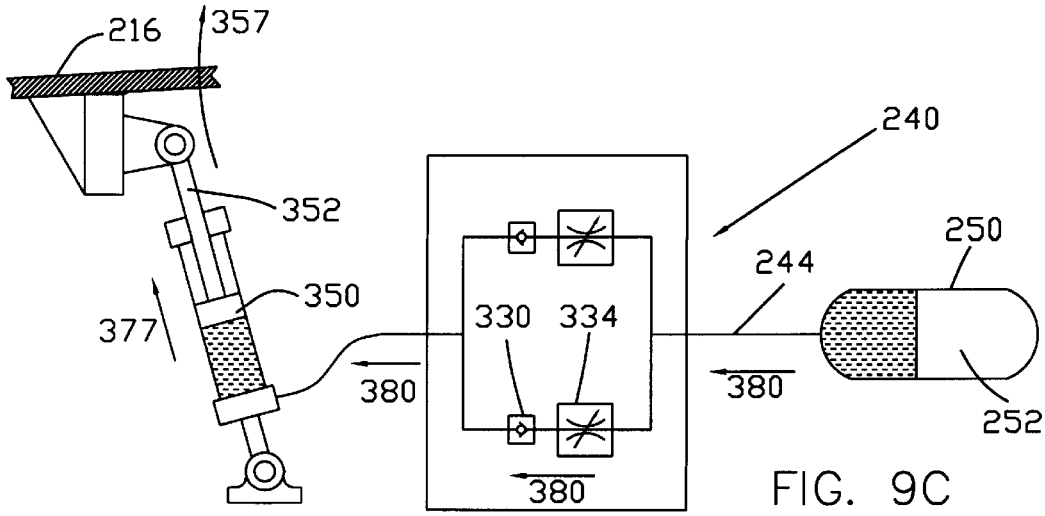
FIG. 9C is a simplified schematic drawing of the hydraulic control block in a configuration corresponding to the intermediate position.

It is appreciated that the operation of raising check valve 430 and flow control valve 434 is similar to the operation of raising check valve 330 and flow control valve 334 as described hereinabove with respect to the embodiment of FIG. 9C. Thus the operation of check valve 430 and control valve 434 will not be repeated here for the sake of conciseness.

Reference is now made to FIG. 1I which is a simplified block diagram of an electronic controller 441 useful in controlling the hydraulic control block of FIG. 10.

The electronic controller 441 may comprise a conventional suitably programmed microcontroller 500. Alternatively, the electronic controller 441 may comprise a conventional suitably programmed programmable logic controller. The electronic controller 441 may also comprise a sound sensor circuit 502 operative to send a sound activation signal to the microcontroller 500 when a characteristic sound wave is received. The characteristic sound wave may for example be a siren of an emergency vehicle.

The electronic controller 441 may also comprise a radio receiving circuit 504 operative to send a radio activation signal to the microcontroller 500 when a characteristic radio signal is received. The characteristic radio signal may for example be transmitted by a centrally located radio transmitter or by an emergency vehicle.

The electronic controller 441 may also comprise a radar sensing circuit 506 operative to send a radar activation signal to the microcontroller 500 when a characteristic radar signal is received. The characteristic radar signal may for example be transmitted by a centrally located radar transmitter or by a transmitter located on an emergency vehicle. The electronic controller 441 may also comprise a timing circuit 508 operative to send a timing signal to the microcontroller 500. The timing circuit 508 may comprise a conventional clock mechanism or any other suitable timing mechanism.

The electronic controller 441 may also comprise a power supply circuit 510. The power supply circuit 510 may comprise a conventional battery (not shown) and a conventional battery charging circuit (not shown) for providing power to the electronic controller 441 and to the selector valve 450. The power supply circuit may also comprise a power cord 512 for providing power from mains electricity or from any other source of electrical energy. Alternatively, the power cord 512 may provide power by a generator as will be described below with reference to FIG. 12.

The electronic controller 441 is operative to send the second control signal to the second solenoid 480 via the second solenoid control wire 482 in the presence of a signal from the sound sensor 502, the radio receiving circuit 504, the radar sensing circuit 506 or the timing circuit 508 thereby establishing fluid communication from the piston and cylinder assembly 230 to the accumulator 250 via the second flow control valve 454.

It will be appreciated therefore that when a signal from any of the sensors 502, 504, 506 or the timing circuit 508 is received by the microprocessor 492, the ramp assembly will have a soft characteristic thereby allowing, for example, an emergency vehicle to pass easily over the speed bump apparatus 214.

The electronic controller 441 is also operative to send the first control signal to the first solenoid 470 via the first solenoid control wire 472 in the absence of a signal from any of the sensors 502, 504, 506 and timing circuit 508 thereby establishing fluid communication from the piston and cylinder assembly 230 to the accumulator 250 via the first flow control valve 412.

It will be also be appreciated therefore that when a signal from any of the sensors 502, 504, 506 or the timing circuit 508 is not received by the microprocessor 500, the ramp assembly will have a stiff characteristic thereby warning a driver of the vehicle that he is driving to fast.

It will be appreciated that the electronic controller 441 is not the main subject of the present invention and is described in general terms only.

Operation of the hydraulic control block 440 will now be described by way of example for the case when the external signal is a siren from an emergency vehicle. As the emergency vehicle approaches the speed bump apparatus 214, the siren activates the sound sensing circuit 50. thereby activating the second solenoid 480. As the emergency vehicle moves over the speed bump 214, the fluid 246 moves from the piston and cylinder assembly 230 to the accumulator 250 via the second flow control valve 454. The second flow control valve 454, which as described hereinabove is set to about ½ to about ⅘ of the full opening, imparts a small pressure drop to the fluid 246 flowing therethrough, thereby allowing the ramp assembly 216 to tilt quickly into the trench 222. It will be apparent therefore that the speed bump 214 will not substantially impede the vehicle motion over the speed bump even if the speed of the emergency vehicle is high.

If the siren is not activated the microcontroller 500 is operative to activate the first solenoid 470. As the vehicle moves over the speed bump 214, the fluid 246 moves from the piston and cylinder assembly 230 to the accumulator 250 via the first flow control valve 412. The first flow control valve 412, which as described hereinabove is set to about ⅕ to about ½ of the full opening, imparts a large pressure drop to the fluid 246 flowing therethrough, thereby preventing the ramp assembly 216 from tilting quickly into the trench 222. It will be apparent therefore that the speed bump 214 will substantially impede the vehicle motion over the speed bump.

As an additional example, by adjusting the timing circuit 508, the controller 441 may be operative to activate the first solenoid 470 during predetermined time intervals such as during rush hours or during daylight hours, thereby causing the speed bump apparatus 214 to have a stiff characteristic and substantially impeding fast moving vehicles. The second solenoid 480 may be activated during the night time hours thereby causing the speed bump apparatus 214 to have a soft characteristic.

Figure 12:
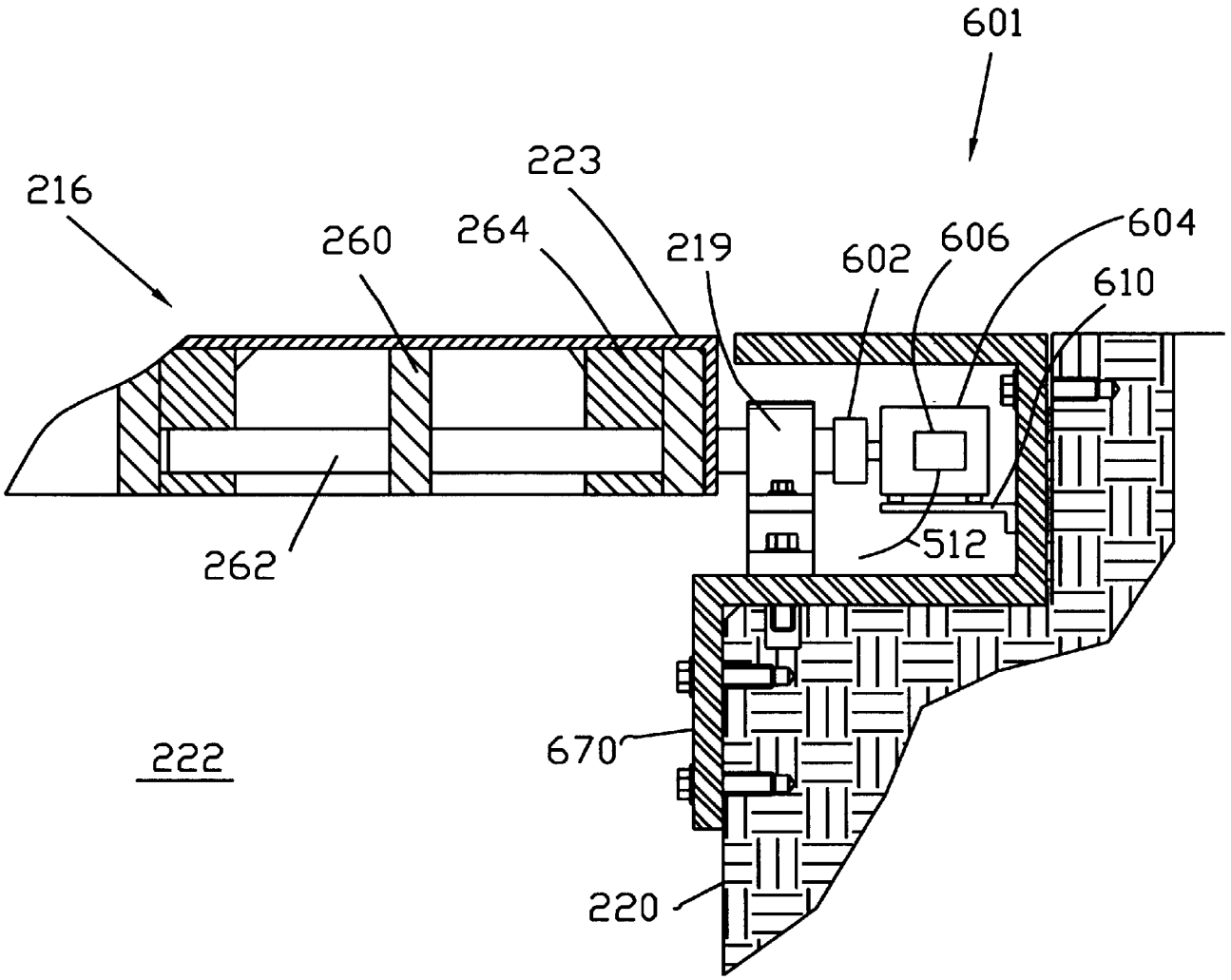
FIG. 12 is a simplified drawing of a generator assembly useful in providing power to the electronic controller shown in FIG. 11.

Reference is now made to FIG. 12 which is a simplified drawing of a generator assembly 601 useful in providing power to the electronic controller 441. As seen in FIG. 12, the generator assembly may comprise a conventional generator 604 drivingly connected to the right hand end 223 of the rod element 262 via a conventional mechanical coupling 602. The generator 604 may be supported by a shelf 610 which is fixedly attached to a hooked shaped bracket 670. The hook shaped bracket 670 may be similar to the hook shaped bracket 270 of FIG. 7B.

The generator 604 may comprise a step-up gear (not shown) which may be integrated into the generator 604. The step-up gear is operative to increase the rotational speed of the support rod 262 so that the generator 604 may rotate at a favorable rate of speed.

The generator assembly 601 also comprises a rectifier circuit 606 which is operative to convert the current produced by the generator 604 to a dc value which is suitable for charging the battery of the power supply circuit 510. The rectifier circuit 606 is electrically connected to the power supply circuit 510 via the power cord 512.

Operation of the generator assembly 601 is now described.

As described hereinabove, as a vehicle moves over the variable speed bump 214, the ramp assembly 216 is tilted into the trench 272, thereby causing the support rod 262 to rotate. The rotation of the support rod 262 imparts a rotation to the generator 604, thereby producing an electric current.

The current is rectified and provided to the power supply circuit 510 to maintain the state of charge of the battery.

It will be appreciated that the generator 604 will provide electric power to the power supply circuit 510 when the ramp assembly 216 is moving for the upper position towards the lower position. It will also be appreciated that the generator 604 may also provide power to the power supply circuit 510 when the ramp assembly 216 returns to the upper position after that vehicle has passed over the ramp assembly 216.

It will also be appreciated that the ramp assembly 16 of FIG. 1 may be supported by the hydraulic piston and cylinder assembly 230 of FIG. 7A. It will further be appreciated that the pair of ramp elements 116*a* and 116*b* of FIG. 6 may be supported by the hydraulic piston and cylinder assembly 230 of FIG. 7A. It will also be appreciated that the ramp assembly 216 of FIG. 7A may be supported by the pneumatic cylinder 26 of FIG. 2.

It will still further be appreciated that the coil spring 62 of FIG. 5 may be used to return the ramp assembly 216 of the embodiment shown in FIG. 7A towards the upper position.

It will be appreciated that the variable speed bump apparatus 214 of FIG. 7A for operation on a two way street may also be implemented with the ramp assembly shown in FIG. 6.

It will be appreciated that the variable speed bump can be adopted to various driving speeds, thus allowing it be implemented a large number of residential and commercial application.

It will be appreciated that other types of electronic sensors may also be useful in electronic controller 441.

In summary, the self-activated variable speed bump of the present invention will avoid the inconvenience and unpleasant feeling of drivers bumping time and again on the fixed bumps as presently known in this art, while still fulfilling its guarding task against lawbreaking drivers.

It will be appreciated by persons skilled in the art that the present invention is not limited by what has been particularly shown and described hereinabove. Rather, the scope of the invention is defined only by the claims which follow:

I claim:

1. A variable speed bump apparatus comprising:

a pivoting ramp element hinged at one end and arranged for angular motion about said one end;

at least one piston and cylinder assembly supporting said pivoting ramp element, said at least one piston and cylinder assembly comprising a piston arranged for reciprocating sliding motion against a fluid in a cylinder, said cylinder having an orifice through which said fluid can be evacuated when said piston presses against said fluid; and a first flow control valve arranged to close against said orifice, an amount of closing of said first flow control valve against said orifice controlling the rate of passage of said fluid through said orifice, wherein a duration of a downward force applied against said ramp element causes an angular downward motion of said ramp element about said one end and causes said piston to press against said fluid, wherein a shorter such duration increases a pressure drop of said fluid through said orifice and retards the angular downward motion of said ramp element, and a longer such duration decreases a pressure drop of said fluid through said orifice and hastens the angular downward motion of said ramp element.

2. A variable speed bump apparatus according to claim 1 and also comprising:

a second flow control valve and wherein said first flow control valve is operative to control a motion of said pivoting ramp element when moving from an upper position towards a lower position and wherein said second flow control valve is operative to control said motion of said pivoting ramp element when returning towards said upper position.

3. A variable speed bump apparatus according to claim 2 and also comprising:

an energy storage apparatus; and a fluid and wherein said first flow control valve is interposed between said at least one piston and cylinder assembly and said energy storage apparatus and wherein said first flow control valve is operative to impart a first pressure drop to said fluid flowing therethrough when said pivoting ramp element moves from said upper position towards said lower position.

4. A variable speed bump apparatus according to claim 3 and wherein said second flow control valve is interposed between said energy storage apparatus and said at least one piston and cylinder assembly and wherein said second flow control valve is operative to impart a second pressure drop to said fluid flowing therethrough when said pivoting ramp element moves towards said upper position.

5. A variable speed bump apparatus according to claim 3 and also comprising:

a third flow control valve disposed between said piston and cylinder assembly and said energy storage apparatus; and a control system and wherein said control system is operative to selectively direct the flow of said fluid through said first flow control valve and said third flow control valve in response to an external signal.

6. A variable speed bump assembly according to claim 5 wherein said external signal is selected from the group consisting of a timing signal, a sound signal, a radio signal and a radar signal.

7. A variable speed bump assembly according to claim 5 and also comprising a generator and wherein said generator is operative to provide energy to said control system when a vehicle passes over said ramp assembly.

8. A variable speed bump assembly according to claim 3 and wherein said energy storage apparatus is an accumulator.

9. A variable speed bump apparatus according to claim 1 wherein said piston and cylinder assembly comprises a hydraulic piston and cylinder assembly.

10. A variable speed bump apparatus according to claim 1 wherein said piston and cylinder assembly comprises a pneumatic piston and cylinder assembly.

11. A variable speed bump assembly according to claim 1 and wherein a response of said ramp assembly is substantially proportional to a square of the speed of a vehicle passing over said ramp assembly.

12. A variable speed bump assembly according to claim 1 and wherein said ramp assembly is coupled to a second complementary ramp assembly installed in a mirror image relationship.

* * * * *